United States Patent [19]

Binkley

[11] Patent Number: 4,868,543

[45] Date of Patent: Sep. 19, 1989

[54] REMOTE MAILBOX ALARM SYSTEM

[75] Inventor: Dennis E. Binkley, Seattle, Wash.

[73] Assignee: Synpac Corporation, Bothell, Wash.

[21] Appl. No.: 940,549

[22] Filed: Dec. 12, 1986

[51] Int. Cl.[4] ..... G08B 21/00

[52] U.S. Cl. ..... 340/569; 250/222.1; 341/527; 341/691; 341/693

[58] Field of Search ..... 340/569, 693, 691, 527, 340/568, 570, 571, 572; 250/222.1, 214 AL

[56] References Cited

U.S. PATENT DOCUMENTS

| | | | |
|---|---|---|---|
| 2,968,804 | 3/1957 | Buffington | 340/569 |
| 3,909,819 | 9/1975 | Radford | 340/545 |
| 4,101,877 | 7/1978 | Rush | 340/569 |
| 4,157,540 | 6/1979 | Oros | 340/527 |
| 4,163,225 | 7/1979 | Engel | 340/569 |
| 4,198,563 | 4/1980 | Elssner | 250/214 AL |
| 4,450,351 | 5/1984 | Fraden | 340/527 |
| 4,458,146 | 7/1984 | Reiner et al. | 250/222.1 |
| 4,520,350 | 5/1985 | Huang | 340/691 |
| 4,794,377 | 12/1988 | Benages | 340/527 |
| 5,590,410 | 5/1986 | Jönsson | 250/222.1 |

*Primary Examiner*—Glen R. Swann, III

*Attorney, Agent, or Firm*—Christensen, O'Connor, Johnson & Kindness

[57] ABSTRACT

A remote mailbox alarm system comprising a mailbox unit (10) and a house module (14) is disclosed. The mailbox unit (10) comprises a position-sensitive door switch (22) which activates timer circuit (54), a mail sensing circuit (37), and a transmitter (56) located on an insert board (24) insertable inside mailbox (12). When activated, mail sensing circuit (37) energizes a light-emitting diode (34) to emit infrared light waves that reflect off mail placed inside mailbox (12) and onto phototransistor (36) which thereby causes the transmitter switch (49) to energize transmitter (56). When door switch (22) is opened, the timer circuit (54) allows the transmitter (56) to continue transmitting for a predetermined period of time. Signals from transmitter (56) are received by receiver circuit (58) which activates a speaker (60) and a lamp (48). When the timer circuit (54) times out, the speaker (60) is deactivated while lamp (48) continues lit until deenergized by the pushing of reset switch (62).

10 Claims, 2 Drawing Sheets

REMOTE MAILBOX ALARM SYSTEM

TECHNICAL FIELD

This invention pertains to devices for signaling when mail has been delivered. In particular, this invention relates to electronic mailbox signaling devices that include a transmitter located at a mailbox and an associated remote receiver for indicating the prescence of mail in the mailbox.

BACKGROUND OF THE INVENTION

Residents of homes having rural mailboxes or living in apartments or condominiums where mail is not delivered to the door must physically check the mailbox for the presence of mail. This can be inconvenient and time consuming when the mailbox is not close by, especially for those of limited mobility. Inconvenience and time consumption is significantly increased when it becomes necessary to retrieve, promptly after delivery, important or valuable mail in order to meet time demands or prevent theft.

A number of methods have been developed for notifying a remote resident when mail has been delivered. One system utilizes a light bulb located on the mailbox being lit when the mailbox door has been opened and remains lit after the door has been closed, until a circuit controlling the energization of the light bulb is reset by the resident. One disadvantage of this system is that it requires the mailbox to be viewable by the resident. Another disadvantage is that some systems of this type route current through underground wires to the mailbox to supply power to the light bulb and related circuits, thus increasing the cost and effort required to install and use the system. A further disadvantage of the outside light is it visually indicates to the public that there is mail in the mailbox and that no one may be at home to pick up the mail, thus enhancing the possibility of theft of mail and home burglary.

Another method involves the simple placement of a light-detecting electric cell (e.g., a photocell) inside a mailbox that activates an alarm circuit inside the home when the mailbox door is opened. This method has the disadvantage of requiring underground wires to connect the photocell to the alarm circuit. A further disadvantage is that the alarm circuit is activated whenever the mailbox is opened in the presence of light regardless of whether mail has actually been placed inside the mailbox.

An additional previously proposed mail reception indicating device includes a transmitter located inside the mailbox that transmits a signal to a receiver located in the home when mail is delivered. See U.S. Pat. No. 4,520,350. For this device to properly function, the mail carrier must raise or lower a flag on the outside of the mailbox in sequence with the opening and closing of the mailbox door. The sequence of operation is determined by whether mail is being picked up, delivered, not delivered, or a combination thereof. The complexity of the device as well as the cooperation required of a mail carrier renders it cumbersome and impractical.

SUMMARY OF THE INVENTION

In accordance with the present invention, a remote mailbox alarm system having a transmitter that transmits a signal to a remote receiver when mail has been placed in a mailbox is provided. A position-sensitive switch attached to the mailbox activates a timer circuit when the mailbox door is opened. When activated, the timer circuit enables a mail sensing device that detects the presence of mail in the mailbox. When mail is present the mail sensing device energizes a transmitter that transmits a signal to a remote receiver located inside the home or apartment that, in turn, activates an alarm. The transmitter continues to transmit for a period of time determined by the timer circuit. Preferably, after the mailbox door is closed, the residence alarm continues to operate after the timer circuit times out, until it is manually reset.

In accordance with further aspects of this invention, the mail sensing device is a photoelectric type sensing device, preferably a reflective type photoelectric device operating in the infrared range and is mounted on the lower surface of the mailbox.

In accordance with further aspects of this invention, the alarm is an audiovisual alarm and the circuits located in the mailbox are battery energized. Preferably, one portion of the audiovisual alarm, i.e., the audio portion, terminates when the transmitter stops transmitting while the other portion, i.e., the visual portion, remains actuated until manually reset.

The advantages of the present invention include simplicity of installation and operation as well as low cost. The use of a timer circuit to control the application of power to the mail sensing device, and the use of the mail sensing device to control application of power to the transmitter prevents rapid discharge of the battery. Because the remote receiver can utilize house current, the audiovisual alarm can operate for an indefinite period of time. Another advantage is that the mail sensing device activates the transmitter circuit only after mail is actually placed inside the mailbox. A further advantage is that the audible alarm will reemit sound whenever the mailbox door is opened after mail has been delivered, thereby warning the resident of a possible theft of mail. The operation of the alarm system requires no extra effort on the part of the mail carrier or the resident, except the simple pushing of a reset switch on the receiver when the resident turns off the visual alarm. Installation merely involves the insertion of a false bottom into the mailbox and the positioning of a small switch to sense the opening of the mailbox door. Because the mail sensing device, transmitting circuits, and battery can be made lightweight and compact, they can be positioned underneath and false bottom inside the mailbox. The remote receiver need only be plugged into a house outlet or other source of conventional current.

BRIEF DESCRIPTION OF THE DRAWINGS

The foregoing and other features and advantages of this invention will become better understood from the following detailed description of a preferred embodiment of the invention when considered in conjunction with the accompanying drawings wherein.

DESCRIPTION OF THE PREFERRED EMBODIMENT

Figure 1:
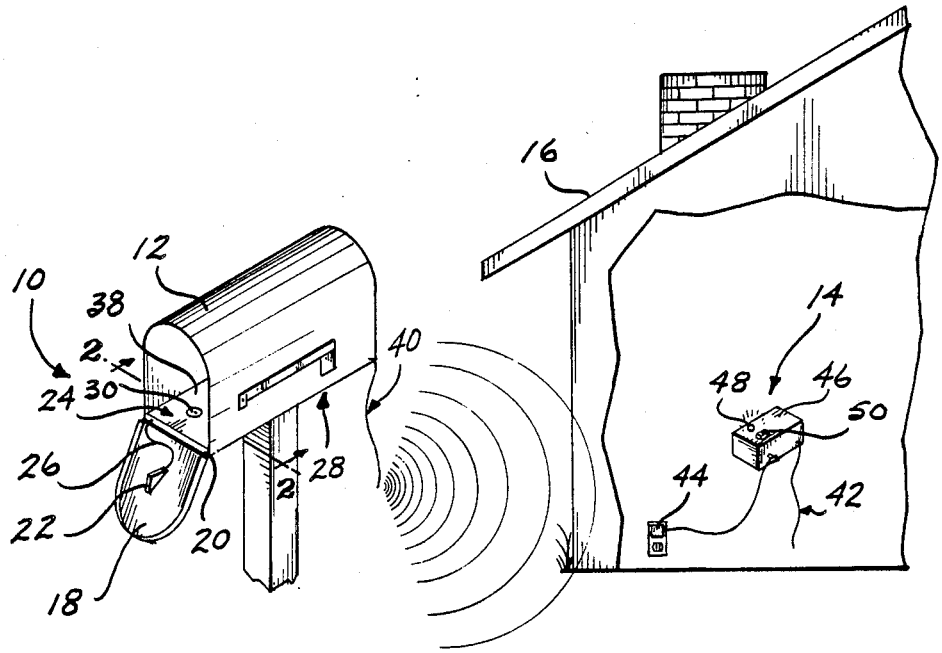
FIG. 1 is an isometric view of the remote mailbox alarm system formed in accordance with the invention.

FIG. 1 illustrates a remote mailbox alarm system formed in accordance with the invention which comprises a mailbox unit 10 mounted inside a mailbox 12 and a house module 14 remotely located inside a house 16. The mailbox 12 has a door 18 attached to the body of the mailbox by a hinge 20. The door 18 is rotatable about the hinge axis between a vertical closed position and a relatively horizontal open position. Although the particular mailbox shown in FIG. 1 is a rural mailbox, the remote mailbox alarm system is adaptable to other mailboxes, such as those used in apartment buildings, which have an openable and closable door.

The mailbox unit 10 comprises a door switch 22 and an insert board 24. Preferably, the door switch 22 is a mercury switch that is mounted on door 18 and oriented so that rotation of the door 18 to a horizontal position closes the switch 22, and rotation of the door 18 to a vertical position opens the switch 22. The door switch 22 is connected to related circuitry on the insert board 24 by wires 26. While, for simplicity, a mercury switch is preferred, it is to be understood that other switch means for detecting the movement of the mailbox door may be used without departing from the scope of the invention. For example, mechanically actuated plunger switches and microswitches, magnetic and electrostatic proximity switches and optical switches can be used. Mailboxes having a door that rotates about a vertical hinge, where a mercury switch will not function, will require one of these alternate type of switches.

The insert board 24 forms a false bottom surface inside mailbox 12. More specifically, the insert board 24 is dimensioned such that it will slidably fit inside mailbox 12 and rest on bottom surface 28. The height of the insert board 24 is sufficient to permit the mounting of a circuit board 29 (FIG. 2) and other components in a cavity formed on the underneath side of the insert board 24. Metal, wood, plastic, or cardboard may be used to construct insert board 24. If desired, the insert board 24 can be permanently attached to the mailbox 12 by using screws, bolts, glue, or other attaching means, without departing from the scope of the invention.

Figure 2:
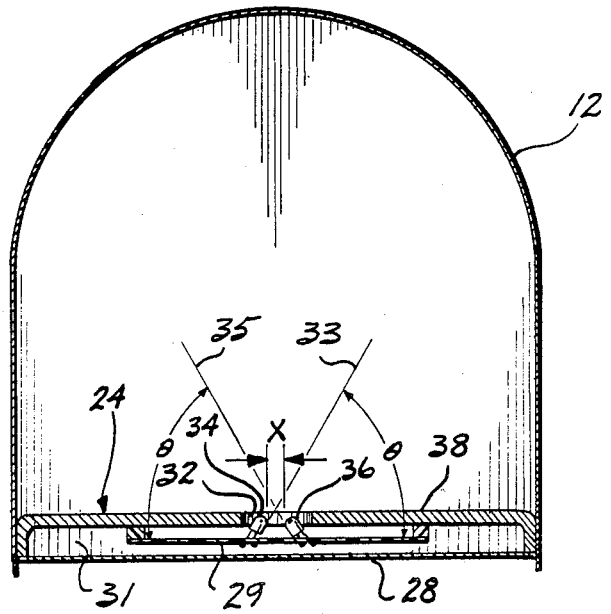
FIG. 2 is a cross-sectional view of the mailbox shown in FIG. 1.

Referring now to FIGS. 1 and 2, a mail sensor 30 formed by a light-emitting diode 34 and phototransistor 36 is mounted on the circuit board 29, in the cavity on the underside of the insert board 24. The light-emitting diode 34 and the phototransistor 36 are positioned beneath an opening in the insert board 24. When properly mounted, the light-emitting axis 33 and the light-detecting axis 35 of the light-emitting diode 34 and the phototransistor 36, respectively, are inclined at an angle, preferably 60°, with reference to the horizontal plane of the bottom surface 28 of the mailbox 12. Further, the light-emitting axis 33 and the light-detecting axis 35 are oriented to incline toward each other and intersect at about the plane defined by the upper surface 38 of the insert board 24. Preferably, the light-emitting diode 34 and the phototransistor 36 are separated by a distance of at least ⅛" as represented by dimension x. Neither the light-emitting diode 34 nor the phototransistor 36 should extend beyond upper surface 38 of insert board 24 in order to prevent these electrical components from being damaged by heavy pieces of mail resting on them. While a light-emitting diode and a phototransistor that operate in the visual range can be used, a light-emitting diode and a photo transistor that operate in the infrared range are preferred.

FIG. 1 also shows a transmission antenna 40 extending from the mailbox 12 and receiving antenna 42 extending from the house module 14. One actual remote mailbox alarm system formed in accordance with the present invention had a maximum range of about 1,800 feet when transmission antenna 40 and receiving antenna 42 were fully extended.

Figure 3:
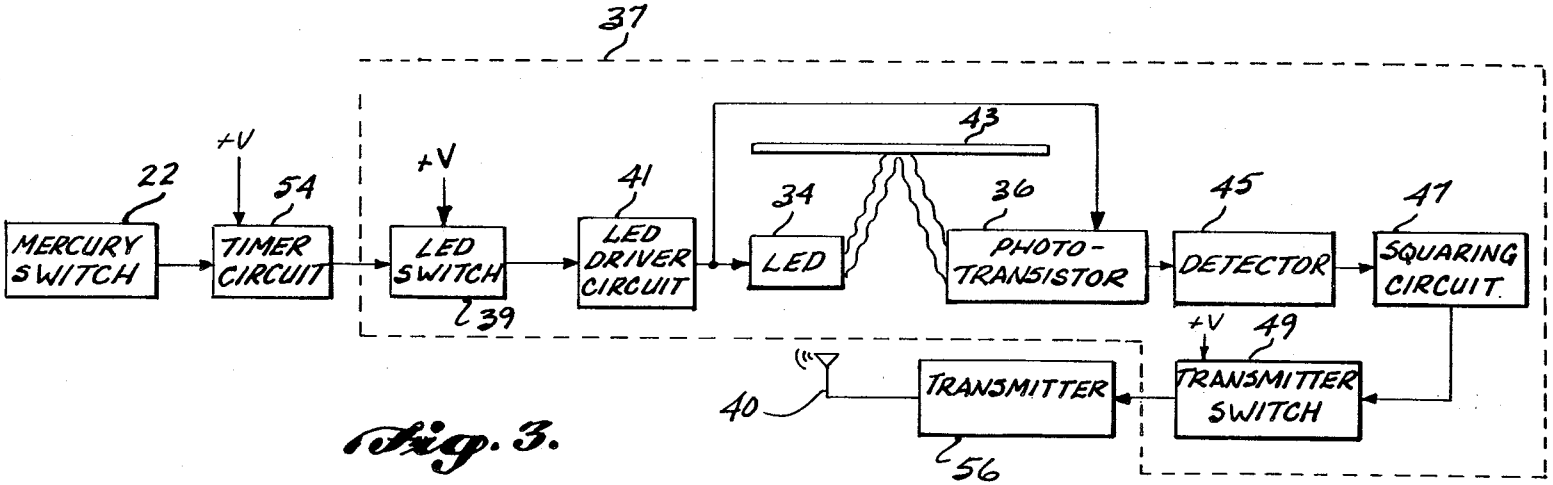
FIG. 3 is a block diagram of a transmitter circuit suitable for use in the embodiment of the invention illustrated in FIG. 1.

In addition to supporting a mail sensing circuit 37 (FIG. 3) that comprises in part light-emitting diode 34 and the phototransistor 36, the circuit board 29 also supports a timer circuit 54 and a transmitter circuit 56, both powered by a battery (not shown). The door switch 22 is connected to the timer circuit 54. The timer circuit 54 is formed such that it is activated when the door switch 22 is closed. The timer circuit 54 produces a bistable output signal that is applied to the LED switch 39. The timer output shifts from its quiescent state (e.g., its low state) to its other state (e.g., its high state) when switch 22 is closed and remains in the other state for a predetermined period of time. When the timer output is in the other state, e.g., its high state, the LED switch 39 enables the LED driver circuit 41 to apply power to the light-emitting diode 34. In addition, phototransistor 36 is enabled by LED driver circuit 41 to respond to the infrared light waves emitted from the LED 34 and reflected off an article of mail 43. The output of the phototransistor created by the received infrared light waves is detected by a detector 45 and the output of the detector is squared by a squaring circuit 47. The detector 45 and squaring circuit 47 together enhance and modify the phototransistor signal. The result is a bistable signal that changes state when the detector 45 detects a reflected infrared signal. The changed state out of the squaring circuit 47 causes the transmitter switch 49 to energize the transmitter 56.

Figure 4:
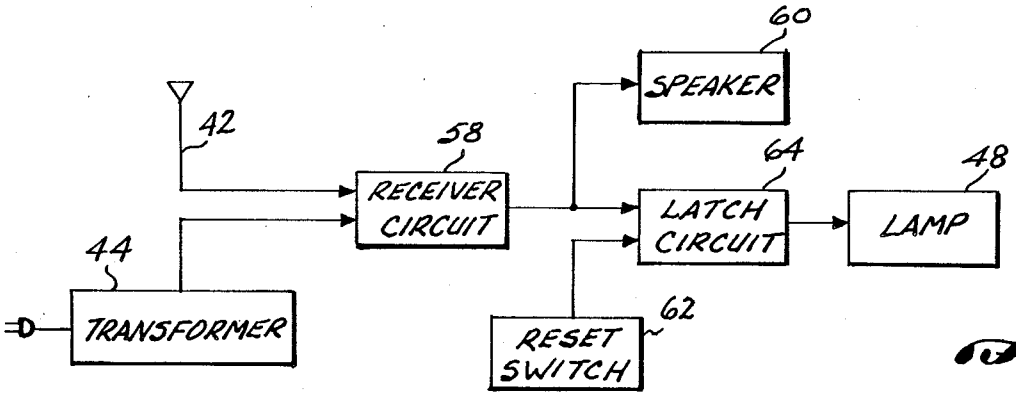
FIG. 4 is a block diagram of a receiver circuit.

As illustrated in FIG. 4, the house module 14 includes a transformer 44, a receiver circuit 58, a visual indicator in the form of a lamp 48, an audible alarm in the form of a speaker 60, a reset switch 62, and an associated latch circuit 64. The transformer 44 supplies power to the receiver circuit 58. The receiver circuit 58 is also connected to the receiver antenna 42, the light 48, the speaker 60, the reset switch 62, and the latch circuit 64. As more fully described below, upon receipt of a signal produced by the transmitter circuit 56, the reciever circuit 58 energizes the speaker 60 and sets the latch circuit 64 which, in turn, energizes lamp 48. Energization of the speaker 60 continues until the transmitter circuit 56 ceases sending a signal. The lamp 48 continues to be energized as long as the latch circuit 64 is set. The latch circuit is reset by the reset switch 62. As shown in FIG. 1, the receiver circuit 58, lamp 48, speaker 60, reset switch 62, and latch circuit 64 can be mounted in a common housing 46 and used with a transformer 44 of the type that is plugged into a standard 110 volt AC outlet.

Turning now to a description of the operation of the remote mailbox alarm system illustrated in FIGS. 1–4; initially, the door 18 is in the closed vertical position, the door switch 22 is open, and the alarm light 48 is not illuminated. When a mail carrier rotates door 18 to its horizontal position, the door switch 22 is closed. Closure of the door switch 22 activates the timer circuit 54 which, in turn, enables the transmitter circuit 56 to respond to the mail sensor 30. Because of the mounting angle, the phototransistor 36 does not sense the light emitted by the light-emitting diode until mail placed atop the opening 32 reflects the light waves produced by the light-emitting diode 34 onto the light sensing surface of the phototransistor 36. The distance above opening 32 at which light waves are reflected to the phototransistor 36 is a function of the srength of the light waves and the angle at which the light-emitting diode 34 and the phototransistor 36 are mounted. While, as noted above, visible light elements can be used, infrared elements are preferred to avoid false actuation by sunlight. If visible light elements are used, preferably, the opening 32 and the photoelectric elements are located at the rear of the mailbox and/or a light modulation scheme is used.

When mail is placed over the mail sensor 30 the infrared light waves emitted by the light-emitting diode 34 are reflected onto the phototransistor 36. The change in the output of the phototransistor is detected by the detector 45. The resulting fluctuating output of the detector is squared by the squaring circuit 47. More specifically, the output of the squaring circuit shifts from a first state (e.g., a low state) to a second state (e.g., a high state) as long as the detector detects that the phototransistor is receiving a reflected infrared signal. When the infrared signal ends, the output of the squaring circuit is to its first state. During the period of time the output of the squaring circuit reverts in its second (e.g., high state), the transmitter switch 49 applies power to the transmitter circuit 56 resulting in the transmitter circuit transmitting a signal to the house module 14 via the transmission antenna 40 and the receiver antenna 42. When the receiver circuit 58 detects the transmitted signal, the light 48 is energized. In addition, speaker 60 emits an audible tone. The receiver circuit 58 may contain a timer circuit to require continuous reception of the transmitted signal for a predetermined period of time before energizing the light 48 and speaker 60. This delay prevents activation of the light 48 and speaker 60 by the momentary reception of extraneous signals. Preferably, the predetermined period of time is at least six seconds.

When the mail carrier rotates the door 18 to the vertical position, the door switch 22 is opened. Thereafter, the timer circuit 54 continues to maintain energization to transmitter circuit 56 through mail sensing circuit 37 for a predetermined period of time of at least ten seconds and, preferably, fifteen seconds. After the predetermined period of time has elapsed, the timer circuit 54 disables the transmitter circuit 56, preferably by terminating the application of power to the transmitter switch 49. Thus, the timer circuit 54 in conjunction with the door switch 22 minimizes battery drain by only allowing the transmitter circuit to remain energized for a short period of time after door 18 is rotated to the vertical position. While the speaker 60 could continue to emit an audible tone after the transmitter circuit 56 is deenergized, preferably, the tone ends when the transmission ends. However, the light 48 remains illuminated as a reminder that mail is present in the mailbox 12 or to notify a resident who had not heard the audible tone that mail is present in the mailbox 12. Since receiver circuit 58 is energized by house current through transformer 44, the continued illumination of light 48 causes no battery drain. After mail has been removed from the mailbox 12, the actuation of the reset switch 62 deactivates the light 48 and returns the receiver circuit 58 to the initial condition.

While the invention has been illustratively described in its preferred form, it is not intended to limit the scope of the claims that follow to the specifics of that design form, inasmuch as variations equivalent thereto are feasible without departing from the novel inventive concepts involved. For example, mail sensor 30 may be constructed of light-emitting and light-detecting devices operating outside the infrared wave length or can include any of the other types of detectors described above. A further alternative would be the delaying of transmission of a signal until approximately six seconds after the mailbox door is closed to insure mail has been placed in the mailbox, and prevent activation of the light and speaker by pranksters momentarily inserting their hands in the mailbox. These and other variations are contemplated to fall within the scope of the claims that follow.

The embodiments of the invention in which an exclusive property or privilege is claimed as defined as follows:

1. A remote mailbox alarm system for a mailbox having a door that is openable and closable, the remote mailbox alarm system comprising:

a transmitter and an antenna, suitable for being located proximate to a mailbox for transmitting a signal when said transmitter is energized;

switch means suitable for mounting in a mailbox for detecting the opening of the door of said mailbox;

a timer circuit connected to said switch means for producing an output signal for a predetermined period of time after said switch means detects the opening of the door of said mailbox;

mail sensing circuit connected to said timer circuit and said transmitter for energizing said transmitter, said mail sensing circuit including at least one mail sensing means for sensing the presence of mail inside said mailbox, said mail sensing circuit energizing said transmitter only when said timer circuit is producing an output signal and said mail sensing means detects the presence of mail inside said mailbox;

a remote receiver and an antenna for receiving said signal, transmitted by said transmitter suitable for being located in a residence remote from said mailbox; and an alarm means coupled to said receiver, said alarm means being activated by said receiver when said receiver receives said signal produced by said transmitter.

2. A remote mailbox alarm system of claim 1, wherein said switch means further comprises a two state position-sensitive switch attached to said door of said mailbox, said position-sensitive switch being in one state when said door is shut and said position-sensitive switch being in the other state when said door is not shut.

3. A remote mailbox alarm system of claim 2, wherein said position-sensitive switch is a mercury switch.

4. A remote mailbox alarm system of claim 3, wherein said mercury switch is attached to the door of said mailbox.

5. A remote mailbox alarm system of claim 1, wherein said predetermined period of time is at least ten seconds.

6. A remote mailbox alarm system of claim 1, wherein said mail sensing means comprises a generating means for generating electromagnetic radiation and a receiving means for receiving electromagnetic radiation, said generating means and said receiving means being oriented such that when mail is placed within a predetermined distance of said generating means, the electromagnetic radiation is reflected off said mail into said receiving means.

7. A remote mailbox alarm system of claim 6, wherein said generating means comprises an infrared-emitting diode and said receiving means comprises an infrared-sensing diode.

8. A remote mailbox alarm system of claim 1, wherein said alarm means comprises an audiovisual alarm.

9. A remote mailbox alarm system of claim 8, wherein said audiovisual alarm comprises a light and a speaker.

10. A remote mailbox alarm system of claim 9, wherein said light is a light-emitting diode.

* * * * *